US005548104A

United States Patent [19]

Ko

[11] Patent Number: 5,548,104

[45] Date of Patent: Aug. 20, 1996

[54] CONTROL APPARATUS OF MICROWAVE OVEN HAVING A MAGNETRON AND SEPERATE HEATING ELEMENT

[75] Inventor: Yeong-Cheol Ko, Suwon, Rep. of Korea

[73] Assignee: Samsung Electronics Co., Ltd., Suwon, Rep. of Korea

[21] Appl. No.: 425,203

[22] Filed: Apr. 20, 1995

[30] Foreign Application Priority Data

Apr. 21, 1994 [KR] Rep. of Korea ..... 94-8475

[51] Int. Cl.[6] ..... H05B 6/68

[52] U.S. Cl. ..... 219/715; 219/702; 219/685; 200/14; 200/38 A

[58] Field of Search ..... 219/715, 702, 219/703, 719, 685, 721, 718; 200/11 R, 11 TW, 14, 5 A, 38 A, 38 FA, 336

[56] References Cited

U.S. PATENT DOCUMENTS 3,621,158 11/1971 Swinstead ..... 200/14

4,227,062 10/1980 Payne et al. ..... 219/718

4,600,826 7/1986 Ishimura ..... 219/492

5,349,164 9/1994 Ohta ..... 219/715

*Primary Examiner*—Philip H. Leung

*Attorney, Agent, or Firm*—Burns, Doane, Swecker & Mathis, L.L.P.

[57] ABSTRACT

A microwave oven includes a magnetron for performing a microwave cooking function, and a separate electric heater element for performing a grilling function. A single control knob on a control panel serves to activate the magnetron and heater element, as well as selecting an output power of the magnetron. By actuating that single knob a user can select cooking operations solely by microwaves only, or solely by the heating element, or by a combination of both. A separate knob on the control panel enables a cooking time to be selected.

8 Claims, 4 Drawing Sheets

CONTROL APPARATUS OF MICROWAVE OVEN HAVING A MAGNETRON AND SEPERATE HEATING ELEMENT

BACKGROUND OF THE INVENTION

1. Field of the Invention

The present invention relates to a control apparatus of a microwave oven, and more particularly to a control apparatus of a microwave oven for selectively controlling microwave oven, grill and combination functions thereof.

2. Description of the Prior Art

Generally, a microwave oven is, as illustrated in FIG. 1, comprised of a cooking chamber 1 of a rectangular shape having an opening at a front surface thereof, a magnetron 2 for oscillating high frequency waves into the cooking chamber 1 to thereby heat and cook the food and a heater 3 for forming a heat energy within the cooking chamber 1 to thereby heat and cook the food.

The microwave oven the thus described can be selectively operated as a microwave oven, a grill, or a combination thereof and the like.

In other words, in case of microwave oven cooking, the magnetron is activated to thereby heat and cook the food disposed in the cooking chamber 1 with the high frequency waves, and in case of grill cooking, the heater 3 is operated to heat and cook the food arranged in the cooking chamber 1 with the heat energy, and in case of a combination cooking, the magnetron 2 and the heater 3 are simultaneously activated to heat and cook the food provided in the cooking chamber 1 with the high frequency waves and the heat energy.

In order to selectively activate the magnetron 2 and the heater 3, a control apparatus is installed.

A conventional control apparatus includes, as illustrated in FIG. 2, a control panel 10 disposed at a frontal right side of the microwave oven, a time control knob 11 disposed at an upper portion of the control panel 10 so as to establish a cooking time, an output control knob 12 disposed under time control knob 11 so as to adjust an output of the magnetron 2, a selection knob 13 arranged under output control knob 12 the type of cooking, i.e., in order to select microwave oven (i.e. "C"), grill and/or the combination cooking methods, and button a 14 provided under the control panel 10 so as to open a door (not shown) for closing the cooking chamber, by way of a pressing operation.

In the conventional control apparatus thus constructed, when the selection knob 13 points to "0" for microwave oven cooking, and the output control knob 12 is rotated to adjust an output of the magnetron 2, and a cooking time is established by the time control knob 11, the high frequency waves are oscillated into the cooking chamber 1 according to operation of the magnetron 2, to thereby heat and cook the food in the cooking chamber 1.

When the selection knob 13 points to "6" for grill cooking and the time control knob 11 is rotated to thereby establish the cooking time during the grill cooking, the heat energy is concentrated in the cooking chamber 1 by way of the operation of the heater 3 so that the food in the cooking chamber 1 can be heated and cooked.

Furthermore, when the selection knob 13 points to "C" for the combination cooking, and the time control knob 11 is rotated to establish the cooking time, the high frequency waves are oscillated into the cooking chamber 1 by way of the operation of the magnetron 2 and at the same time, the heat energy is concentrated in the cooking chamber 1 by way of the operation of the heater 3, so that the food in the cooking chamber 1 can be heated and cooked.

However, there is a problem involving the conventional control apparatus of a microwave oven, because separate knobs must be actuated to select between the available cooking functions and the power output of the magnetron.

There is another problem in that manufacture of the control panel 10 is more difficult because the selection knob 13 and the output control knob 12 must be separately installed.

SUMMARY OF THE INVENTION

Accordingly, the present invention is disclosed to solve the afore-referenced problems and it is an object of the present invention to provide a control apparatus of a microwave oven employing one knob for simultaneous use in controlling output of a magnetron and in selecting microwave oven, grill and/or combination cookings, so that convenience is provided for knob operations and at the same time, cost reduction for manufacturing the control panel can be accomplished.

In accordance with the object of the present invention, there is provided a control apparatus of a microwave oven, the apparatus comprising:

a time control unit disposed at a control panel so as to establish a cooking time according to a rotary operation of a time control knob;

an output control unit disposed at the control panel in order to intermittently control a high frequency wave oscillation of a magnetron;

a magnetron switch disposed at the control panel in order to turn on or turn off the magnetron;

a heater switch disposed at the control panel so as to turn on or turn off a heater; and function setting means disposed at the control panel in order to selectively operate the magnetron switch and the heater switch according to the rotary operation of a function setting knob and at the same time, to control an output of the output control unit.

BRIEF DESCRIPTION OF THE DRAWINGS

For a fuller understanding of the nature and objects of the invention, reference should be made to the following detailed description taken in conjuction with the accompanying drawings in which.

DETAILED DESCRIPTION OF THE INVENTION

A preferred embodiment of the present invention will now be described in detail with reference to the accompanying drawings.

Figure 1:
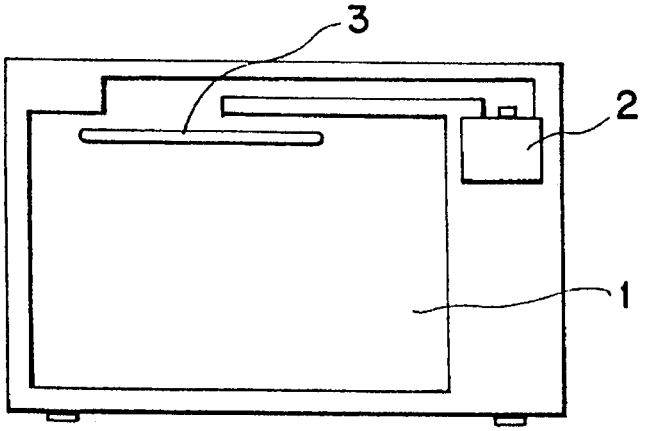
FIG. 1 (PRIOR ART)
FIG. 1 is a front sectional view of a conventional microwave oven.
Figure 2:
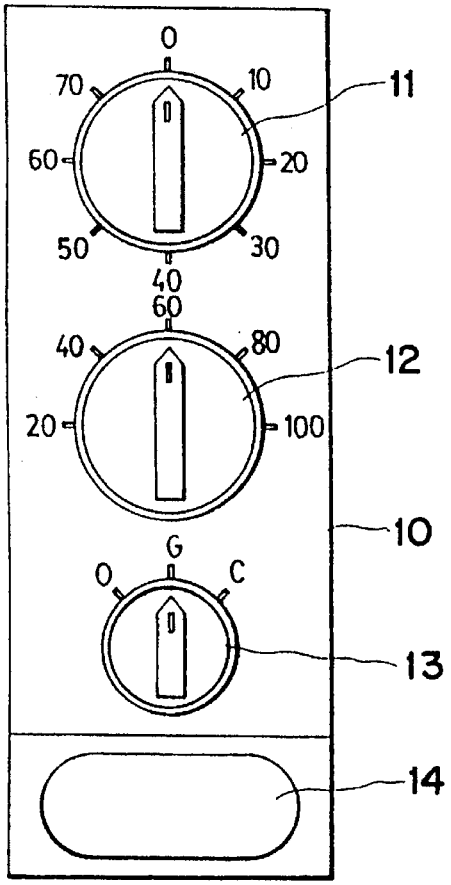
FIG. 2 (PRIOR ART)
FIG. 2 is a front view of a control apparatus according to the conventional microwave oven.

Throughout the drawings, like reference numerals and symbols as referred to in FIG. 1 are used for designation of like or equivalent parts or portions, for simplicity of illustration and explanation, and redundant descriptions are omitted.

Figure 3:
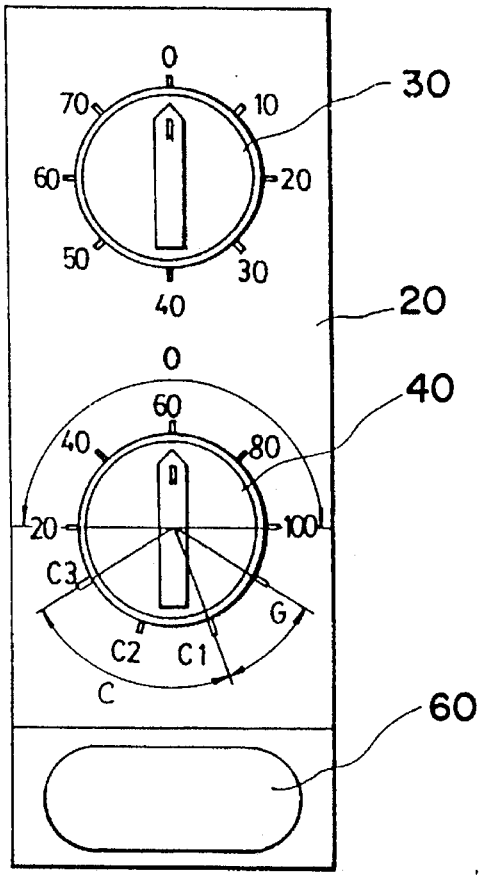
FIG. 3 is a front view of a control apparatus according to the present invention.

FIG. 3 is a front view of a control apparatus according to the present invention, where the control apparatus includes a control panel 20 disposed at a frontal right side of the microwave oven, a time control knob 30 arranged at an upper side of the control panel 20 so as to establish a cooking time, function setting means 50 employing a function setting knob 40 on the control panel 20 and disposed at a lower side of the time control knob 30 in order to (i) control an output of a magnetron 2 and (ii) select a microwave oven, grill and/or combination type of cooking, and a button 60 provided at a lower area of the control panel 20 so that a door (not shown) for closing a cooking chamber 32 can be opened by way of a pressing operation.

The function setting knob 40 includes a microwave oven cooking range 0 for operating the magnetron 2 to control an output of the magnetron between power or settings of from 20 to 100 a grill cooking range G for operating a heater 3 for cooking and a combination cooking range C for simultaneously operating the magnetron 2 and the heater 3 for cooking.

At this time, the combination cooking setting C has three stages C1, C2, and C3.

Furthermore, the function setting knob 40 can be rotated 360 degrees, and the cooking can be performed at a certain position where the knob 40 is selected among the microwave oven cooking setting 0, grill cooking setting G and the combination cooking settings C.

Figure 4:
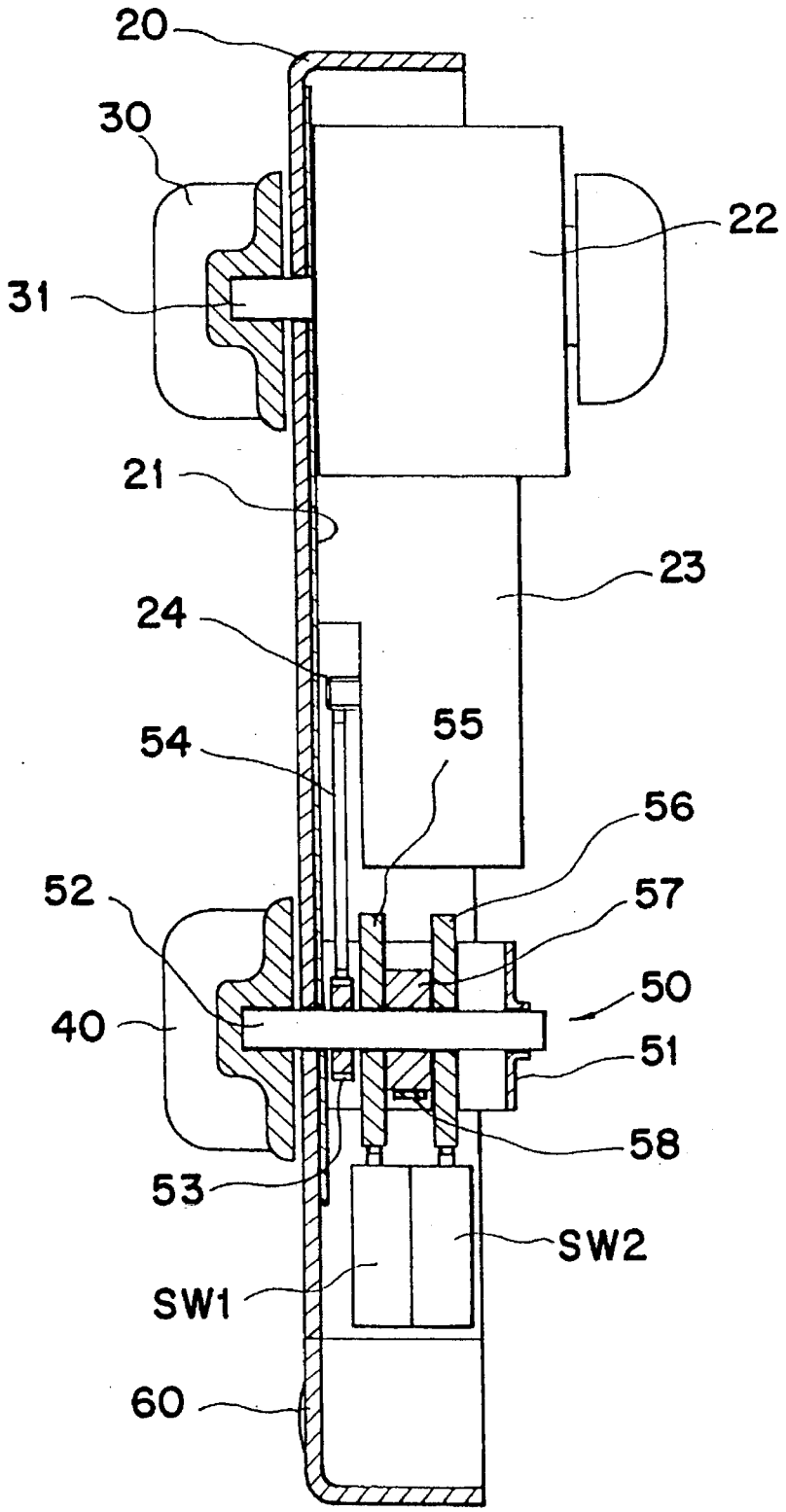
FIG. 4 is a side sectional view of the control apparatus according to the present invention.

FIG. 4 is a side sectional view of the control apparatus according to the present invention, where the control apparatus includes a substrate 21 attached to an inner surface of the control panel 20, a time control unit 22 disposed at an upper portion of the substrate 21 and at the same time arranged on an inner surface of the substrate 21 so that the cooking time can be established by rotation of a shaft 31 connected to the time control unit 22 and the time control knob 30. A output control unit 23 is disposed below the time control unit 22 on the substrate 21 in order to control output of a magnetron 2. A heater switch SW1 in provided at a lower portion of the control panel so that the heater 3 can be turned on and/or turned off, a magnetron switch SW2 is disposed next to the heater switch SW1 20 so that the magnetron 2 can be switched on and/or switched off. A function setting mechanism 50 disposed beneath the output control unit 23 and above the switches SW1 and SW2 so that the microwave oven, grill and combination cookings can be selected.

The function setting mechanism 50 includes a shaft 52 freely rotatably connected between the substrate 21 and a bracket 51 of a "8 " shape, and extending through the substrate 21 and the control panel 20 to thereby be connected to the function setting knob 40. A control gear 53 is coupled to the shaft 52 near an inner side of the substrate 21 so that the same can be simultaneously rotated with the shaft 52. A connecting gear 54 coupled between the control gear 53 and an output gear 24 to thereby rotate the output gear 24 disposed at the output control unit 23. A heater cam 55 is fixedly connected with the shaft 52 in order to turn on or turn off the heater switch SW1, and a magnetron cam 56 is fixedly connected with the shaft so that the magnetron switch SW2 can be switched on and/or switched off.

The magnetron switch SW2 serves to switch on or switch off the magnetron 2, and the output gear 24 is adapted to intermittently control an output of the same in a state where the magnetron switch SW2 is under on-operation.

In other words, the output gear 24 is rotated by the control gear 53 to thereby rotate a rotary switch (not shown) provided at the output control unit 23, so that output of the magnetron 2 is intermittently controlled in the "O" range, i.e., between 20–100 degrees (see FIG. 3).

Meanwhile, a position setting cam 57 is fixedly connected to the shaft 52 between the heater cam 55 and the magnetron cam 56.

The position setting cam 57 makes surface contact with a plate spring 58 connected to the bracket 51, to thereby frictionally maintain the rotation position of the shaft 52

Figure 5:
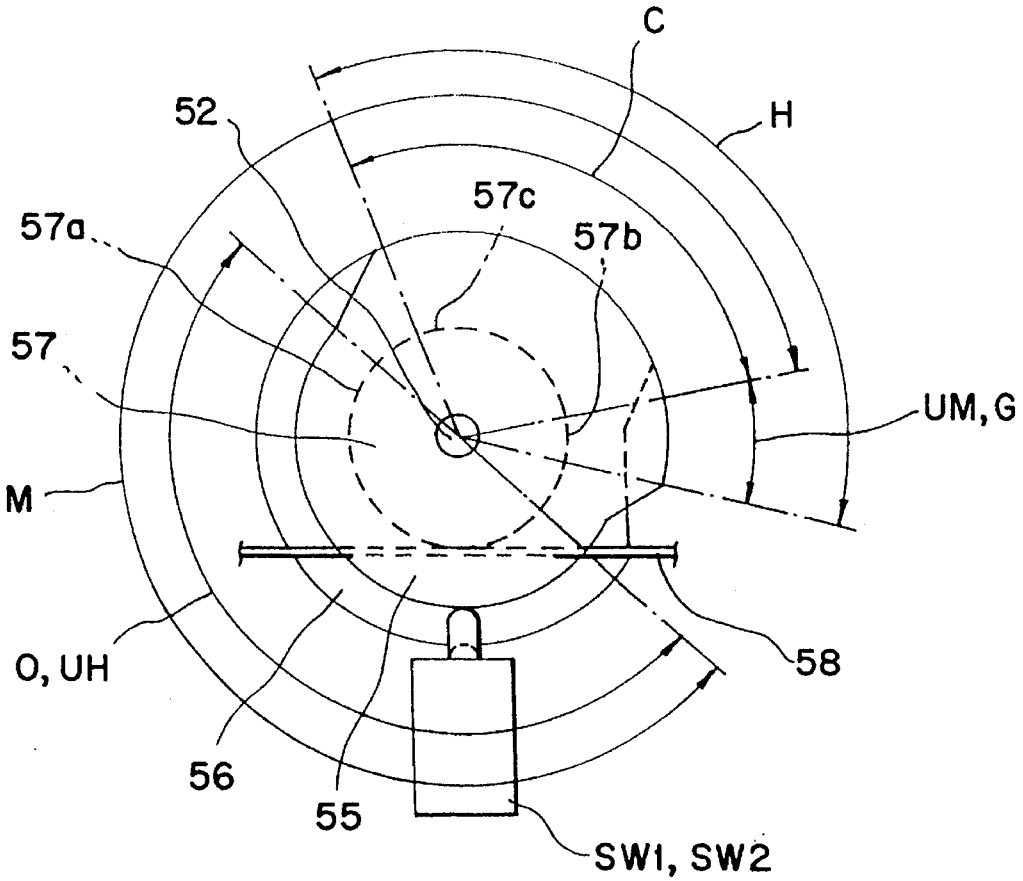
FIG. 5 is a front view of operating cams of the control apparatus according to the present invention.
Figure 6:
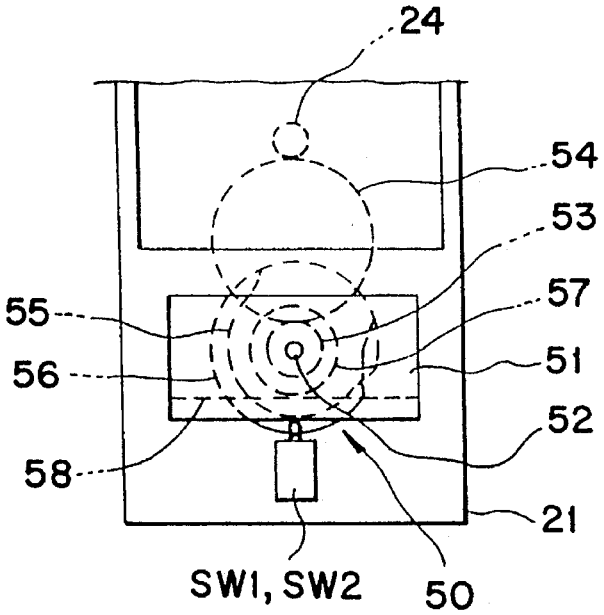
FIG. 6 is a partial rear elevation view of the control apparatus according to the present invention.

FIG. 5 is a front view for illustrating how the cams 55 according to the present invention are overlapped, where the magnetron cam 56 includes a high frequency wave oscillation domain M for activating the magnetron switch SW2, and a non-oscillation domain UM for deactivating the magnetron switch SW2.

A portion of the domain M where only the high frequency waves are oscillated to thereby carry out the cooking is the microwave oven cooking range 0.

When the shaft 52 is rotated in range 0 it turns on the magnetron switch SW2 whereupon, the magnetron 2 is activated.

At this time, the output control unit 23 is controlled by the output gear 24.

The output control unit 23 thus controlled is then caused to control intermittently the output of the activated magnetron 2.

Meanwhile, the heater cam 55 includes of a heating domain H for turning on the heater switch SW1 and a non-heating domain UH coinciding with the microwave oven cooking range 0 to thereby turn off the heater 3.

The non-oscillation domain UH coincides with the grill cooking range G, which causes only the heater 3 to operate. The cooking is carried out by the heat thereof.

Furthermore, the heating domain H minus the grill cooking range (or the high frequency wave oscillation domain M minus the microwave oven cooking range 0) is designated as the combination cooking part C, which performs the cooking by way of the heat from the heater 3 and the oscillated high frequency waves.

The position setting cam 57 is provided at a periphery thereof with a curve unit **57*a* corresponding to the microwave oven range 0, a combination hitch surface 57*b* corresponding to respective combination cooking range C and a grill hitch elevation 57C** corresponding to the grill cooking range G.

Figure 7:
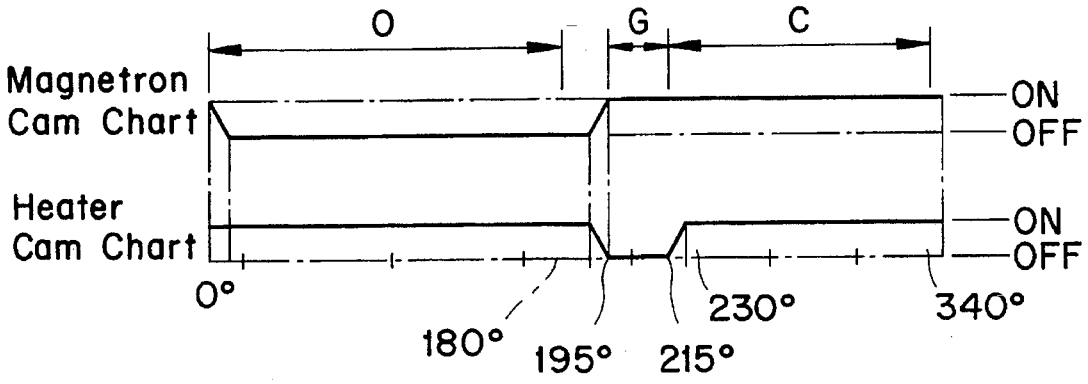
FIG. 7 is a schematic diagram of a cam chart according to the present invention.

FIG. 7 is a schematic diagram of a cam chart according to the present invention, where an upper portion thereof illustrates a magnetron cam chart while a lower portion thereof illustrates a heater cam chart.

Figure 8:
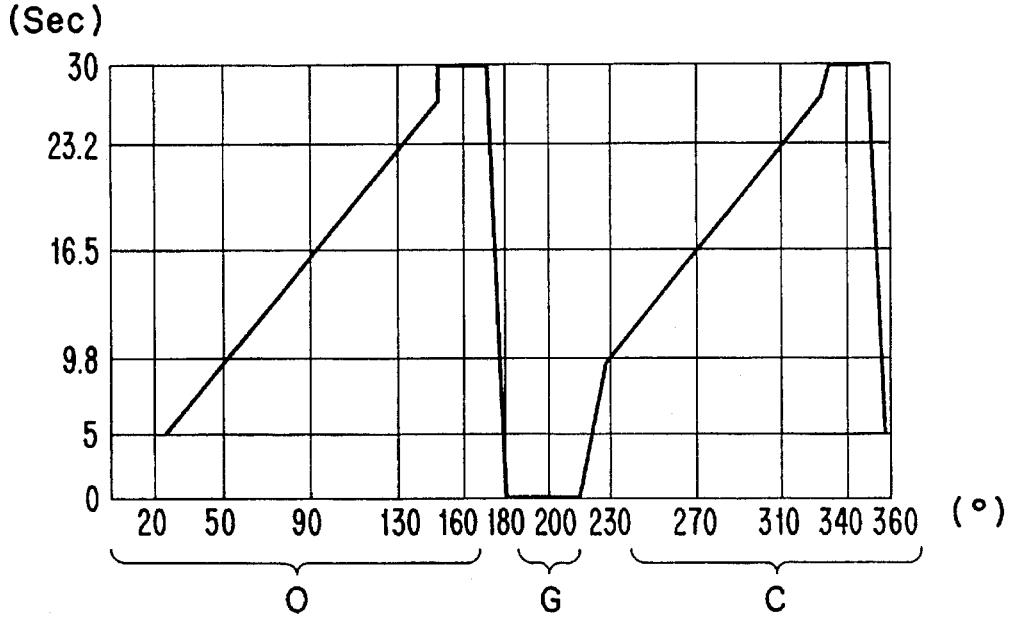
FIG. 8 is a schematic diagram of a high frequency wave output line according to the present invention.

FIG. 8 is a schematic diagram of a high frequency wave output line where a horizontal axis illustrates the microwave oven cooking range 0, grill cooking range G and the combination cooking range C, and a vertical axis displays the output of the magnetron 2.

By way of example, with reference to FIGS. 7 and 8, when the function setting knob 40 is rotated to an angle of 20 degrees (i.e., a relatively low-power setting) in the microwave oven range 0 after the cooking time is established by way of the time control knob 30 during the microwave oven cooking, the magnetron switch SW2 is rendered operative and at the same time, the output gear 24 is rotated, to thereby change in position a rotary switch disposed in the output control unit 23.

The output control unit 23 changed in position prevents the high frequency waves of the on-going magnetron 2 from oscillating for 5 seconds.

In other words, if the established cooking time is 10 minutes, the high frequency waves are oscillated only for 100 seconds, so that a cooking under a low heat condition is carried out.

Alternatively, if the function setting knob 40 is rotated by an angle of 160 degrees in a state where the cooking time is established at 10 minutes, the high frequency waves from the magnetron 2 is continuously oscillated for 30 seconds. In other words, when the established cooking time is 10 minutes, the high frequency waves are oscillated for 10 minutes to thereby cause the cooking to be performed under a high heat condition.

When the cooking time is established to thereafter cause the function setting knob 40 is rotatatively operated in the grill cooking range 6, i.e., within an angle between 195 degrees and 215 degrees only the heater 3 is operated so that the food in the cooking chamber 1 is heated and cooked by the heat from the heater 3 during the established time.

Alternatively, if after the cooking time is established by the function setting knob 40 rotated 230 degrees i.e., in the combination cooking part C, the high frequency waves of the magnetron 2 are oscillated for 8 to 9 seconds but are not oscillated for 20.2 seconds, during which time the food is heated and cooked by heating operation of the heater 3.

As described in the foregoing, the shaft 52 of the function setting knob 40 the control gear 53, heater cam 55, position setting cam 57 and the magnetron cam 56, are rotated altogether at the same time when the function setting knob 40 is rotated, thereby setting in motion the output control unit 23, heater switch SW1 and the magnetron switch SW2.

Next, a cooking process of the present invention thus constructed will be described.

First of all, when the time control knob 30 is rotated during the microwave oven cooking process where the food is heated and cooked by way of the high frequency wave oscillation of the magnetron 2, thereby establishing a cooking time, and the function setting knob 40 is rotated to be positioned in the microwave oven cooking range 0, the heater cam 55 and the magnetron cam 56 are rotated.

At this time, the non-heating domain UH of the heater cam 55 causes the heater switch SW1 to be off, and the microwave oven cooking range 0 of the magnetron cam 56 causes the magnetron switch SW2 to be on, thereby setting the magnetron 2 in operation.

Furthermore, when the control gear 53 combined to the shaft 52 by the rotation of the function setting knob 40 is rotated, the connecting gear 54 is rotated to thereby rotate the output gear 24, and to thereafter operate a rotary switch inherently disposed in the output control unit 23, so that the output power of the high frequency oscillation from the magnetron 2 is intermittently controlled. The food in the cooking chamber 1 is therefore heated and cooked only by the high frequency wave oscillation during the microwave oven cooking.

Alternatively, when the time control knob 30 is rotated to thereby establish a cooking time, and the function setting knob 40 is rotated to the grill cooking range G for heatedly cooking the food by way of the heat of the heater 3, the heater cam 55 connected to the shaft 52 is simultaneously rotated therewith and the heater 3 is operated in accordance with rotation of the heating domain H for activation of the heater switch SW1.

Furthermore, the magnetron cam 56 is rotated simultaneously with the heater cam 55 so that the non-heating domain UM thereof keeps the magnetron switch SW2 off, so that the magnetron 2 is rendered inactive, and the food in the cooking chamber 1 is heated and cooked only by the heat of the heater 3 during the grill cooking process.

Alternatively, during the combination cooking process where the food is heated and cooked by way of high frequency oscillation of the magnetron 2 and the heat of the heater 3, the time control knob 30 is rotated to thereby establish a cooking time and then the function setting knob 40 is rotated to the combination cooking range C. At the same time, one of the appropriate combinations C1, C2 or C3, wherein respective outputs of the magnetron are different, is selected in the combination cooking range C. Then the heater cam 55 rotation of the causes the heater to be operative, and the magnetron cam 56 causes the magnetron to operate.

Furthermore, the control gear 53 is rotated to thereby rotate the output gear 24 whereupon, the output gear 24 sets in operation the rotary switch arranged within the output control unit 23 to thereby control the output of the high frequency waves. Thus, that the food in the cooking chamber 1 can be heated and then cooked by the heat of the heater 3 and oscillation of the high frequency waves from the magnetron during the combination cooking process.

As is apparent from the foregoing, the control apparatus of the microwave oven according to the present invention can provide convenience in operation because the microwave oven cooking, grill cooking and the combination cooking can be operated by one knob.

The present invention also has advantages in that the combination cooking function can be controlled in multi stages by way of a 360-degree rotation of the knob for higher cooking efficiency, and operational efficiency can be increased because of a reduced number of knobs in the production of a control panel.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A microwave oven comprising a cooking chamber, a magnetron for supplying high frequency waves to said cooking chamber, an electric heater element disposed in said cooking chamber, and a control apparatus for controlling operation of said magnetron and said heater element, said control apparatus comprising:

a control panel structure;

a manually actuable time control unit on said control panel structure for setting a cooking time;

a magnetron switch on said control panel structure for turning said magnetron on or off;

a magnetron power output control unit on said control panel structure for selecting a power output level of said magnetron;

a heater switch on said control panel structure for turning said heater element on or off; and a function-setting mechanism on said control panel structure, comprising a single manual actuator operably connected to said magnetron switch, said output control unit, and said heater switch;

said single manual actuator being movable in a first range of movement for displacing said magnetron switch to an on condition with said heater switch disposed in an off condition, and for selecting a magnetron power outlet level; a second range of movement for displacing said heater switch to an on condition with said magnetron switch disposed in an off condition; and a third range of movement for displacing both of said magnetron and heater switches to an on condition and for selecting a magnetron power outlet level.

2. The microwave oven according to claim 1 wherein said manual actuator includes a knob; a shaft; and first, second, and third elements disposed on said shaft and connected to said magnetron switch, output control unit, and heater switch, respectively.

3. The microwave oven according to claim 2 wherein said first element comprises a magnetron cam fixed to said shaft and engageable with said magnetron switch; said second element comprising a gear fixed to said shaft, said gear connected to said output control unit; said third element comprising a heater cam fixed to said shaft and engageable with said heater switch.

4. The microwave oven according to claim 3 wherein one portion of an outer periphery of said microwave cam constitutes a high frequency oscillation domain for turning on said magnetron switch, and another portion of said outer periphery constitutes a non-oscillation domain for deactivating said magnetron switch.

5. The microwave oven according to claim 4 wherein one portion of said heater cam constitutes a heating domain for turning on said heater switch, and another portion of said heater cam constitutes a non-heating domain for deactivating said microwave switch; a first section of said one portion coinciding with said one portion of said microwave cam for enabling cooking to be performed by both said heating element and microwaves.

6. The microwave oven according to claim 5 wherein a second section of said one portion of said outer periphery of said heater cam coincides with said non-oscillation domain of said microwave cam for enabling heating to be performed solely by said heating element.

7. The microwave oven according to said claim 5 wherein said non-heating domain of said heater cam coincides with a section of said one portion of said microwave cam for enabling cooking to be performed solely by microwaves.

8. The microwave oven according to claim 4 wherein one portion of said heater cam constitutes a heating domain for turning on said heater switch, and another portion of said heater cam constitutes a non-heating domain for deactivating said microwave switch, said non-heating domain of said heater cam coinciding with a section of said one portion of said microwave cam for enabling cooking to be performed solely by microwaves.

* * * * *